US006214286B1

(12) United States Patent
Larsen, Jr. et al.

(10) Patent No.: US 6,214,286 B1
(45) Date of Patent: Apr. 10, 2001

(54) HYBRID INDUCTION SKULL MELTING

(75) Inventors: Donald E. Larsen, Jr., Muskegon, MI (US); Christine M. Stabile, Rockaway, NJ (US); Richard A. Biondi, Denville, NJ (US); Donald L. Bierstine, Newton, NJ (US); Robert L. Larsen, Muskegon, MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 08/982,168

(22) Filed: Dec. 1, 1997

(51) Int. Cl.[7] ..... H05B 6/30

(52) U.S. Cl. ..... 266/241; 266/242; 373/155; 373/156

(58) Field of Search ..... 266/241, 242; 373/155, 156

(56) References Cited

U.S. PATENT DOCUMENTS

| | | | |
|---|---|---|---|
| 2,958,913 | 11/1960 | Schaefer | 22/212 |
| 3,013,315 | 12/1961 | Smith | 22/65 |
| 3,593,775 | 7/1971 | Privett | 164/251 |
| 3,775,091 | 11/1973 | Clites et al. | 75/65 |
| 4,058,668 | 11/1977 | Clites | 13/32 |
| 4,675,879 * | 6/1987 | Meredith | 373/155 |
| 4,738,713 | 4/1988 | Stickle et al. | 75/10.18 |
| 4,856,576 | 8/1989 | Peterson | 164/495 |
| 5,149,488 * | 9/1992 | Dickson | 266/242 |
| 5,257,281 | 10/1993 | Cignetti et al. | 373/155 |
| 5,425,048 * | 6/1995 | Heine et al. | 373/151 |
| 5,741,349 * | 4/1998 | Hubble et al. | 266/241 |

OTHER PUBLICATIONS

Merriam–Webster's Collegiate Dictionary, 10th edition. 1997 p. 1008.*

* cited by examiner

*Primary Examiner*—Roy King
*Assistant Examiner*—Tina McGuthry-Banks

(57) ABSTRACT

A solid charge of metal or alloy is placing in a crucible melting chamber defined by a monolithic refractory tubular sleeve disposed on a water cooled metallic base, an energizing induction coil disposed about the sleeve to inductively heat the solid charge to a molten state in the melting chamber including forming a skull of solidified metal or alloy on inner surfaces of the sleeve and base to confine the molten charge, and removing the molten charge from the melting chamber, leaving the skull in place on the inner surfaces of the sleeve and base. The crucible can be reused in melting another solid charge of metal or alloy after the molten charge is removed.

10 Claims, 2 Drawing Sheets

HYBRID INDUCTION SKULL MELTING

FIELD OF THE INVENTION

The invention relates to induction skull melting of metal and alloys.

BACKGROUND OF THE INVENTION

Induction melting processes and apparatus using a water cooled segmented, copper crucible were developed by the US Bureau of Mines, for example, as described in U.S. Pat. Nos. 3,775,091 and 4,058,668. These patents illustrate use of a $CaF_2$ skull in the crucible and refractory packing material/spacers between the segments. The $CaF_2$ skull prevents contact between the molten metal and the crucible segments. Typically, the $CaF_2$ is melted and solidified on the cooled crucible segments to form an insulating lining or skull between the melt and the crucible segments.

U.S. Pat. No. 4,738,713 illustrates an induction melting process wherein a reactive metal is melted in a water cooled segmented, copper crucible in the absence of a $CaF_2$ lining or skull. In this patent, a refractory packing material is required between the tubular segments of the crucible to avoid molten metal penetration therebetween and subsequent skull locking.

The Diehm et al. U.S. Pat. No. 4,923,508 discloses a ceramicless induction skull crucible having a plurality of upstanding, water cooled metallic fingers that collectively form an upper metallic sleeve of the melting crucible and a water cooled metallic bottom. The crucible fingers are spaced by gaps small enough to avoid penetration of molten metal between the fingers that could produce skull locking.

There is a need in the art for an induction skull melting apparatus and method that avoids water cooled crucible sleeve segments or fingers as well as use of $CaF_2$ and other refractory skulls and refractory packing materials between segments that can contaminate the melt and also provide improved service in use in melting metal or alloy charges in a production environment.

An object of the invention is to provide induction skull melting apparatus and method that satisfy this need.

SUMMARY OF THE INVENTION

The present invention provides induction skull melting apparatus and method wherein a charge of metal or alloy is induction melted in a crucible comprising a reusable monolithic refractory tubular sleeve disposed on a reusable water cooled metallic base by an induction coil means disposed about the sleeve.

In one embodiment of the invention, a charge of metal or alloy, such as a reactive superalloy or titanium alloy, is induction melted in a crucible comprising a monolithic refractory cylindrical sleeve disposed on a water cooled metallic disc-shaped base by an induction coil means disposed about the ceramic sleeve. The monolithic sleeve can comprise alumina, zirconia, and other suitable ceramic material compatible with the metal or alloy to be melted. Alternately, the cylindrical sleeve can comprise graphite. The water cooled base can comprise single or multiple copper members that define water cooling channels therebetween.

The induction coil is energized to inductively heat the solid charge to a molten state including forming a solidified skull of the metal or alloy on inner surfaces of the sleeve and the base to confine the molten charge. Thereafter, the molten charge can be removed, for example, by pouring from the melting chamber, leaving the solidified skull in place on the inner surfaces of the sleeve and base.

The invention is advantageous in that water cooled crucible sleeve segments or fingers are eliminated. In addition, the need for $CaF_2$ and other refractory skulls is eliminated. Morever, the need for refractory packing materials between segments that can contaminate the melt is eliminated. The induction melting apparatus of the invention provides improved service in use in melting metal or alloy charges in a production environment in that damage to or spreading of previously used metal crucible segments or fingers is eliminated as a source of crucible downtime. Moreover, practice of the invention can provide a 25% to 50% reduction in electrical power requirements for melting as compared to power requirements using a segmented melting crucible, and greater levitation of the melt in the crucible and thus less reaction with the crucible before a skull forms thereon.

The above objects and advantages of the invention will become more readily apparent to those skilled in the art from the following detailed description taken with the following drawings.

DETAILED DESCRIPTION OF THE INVENTION

Figure 1:
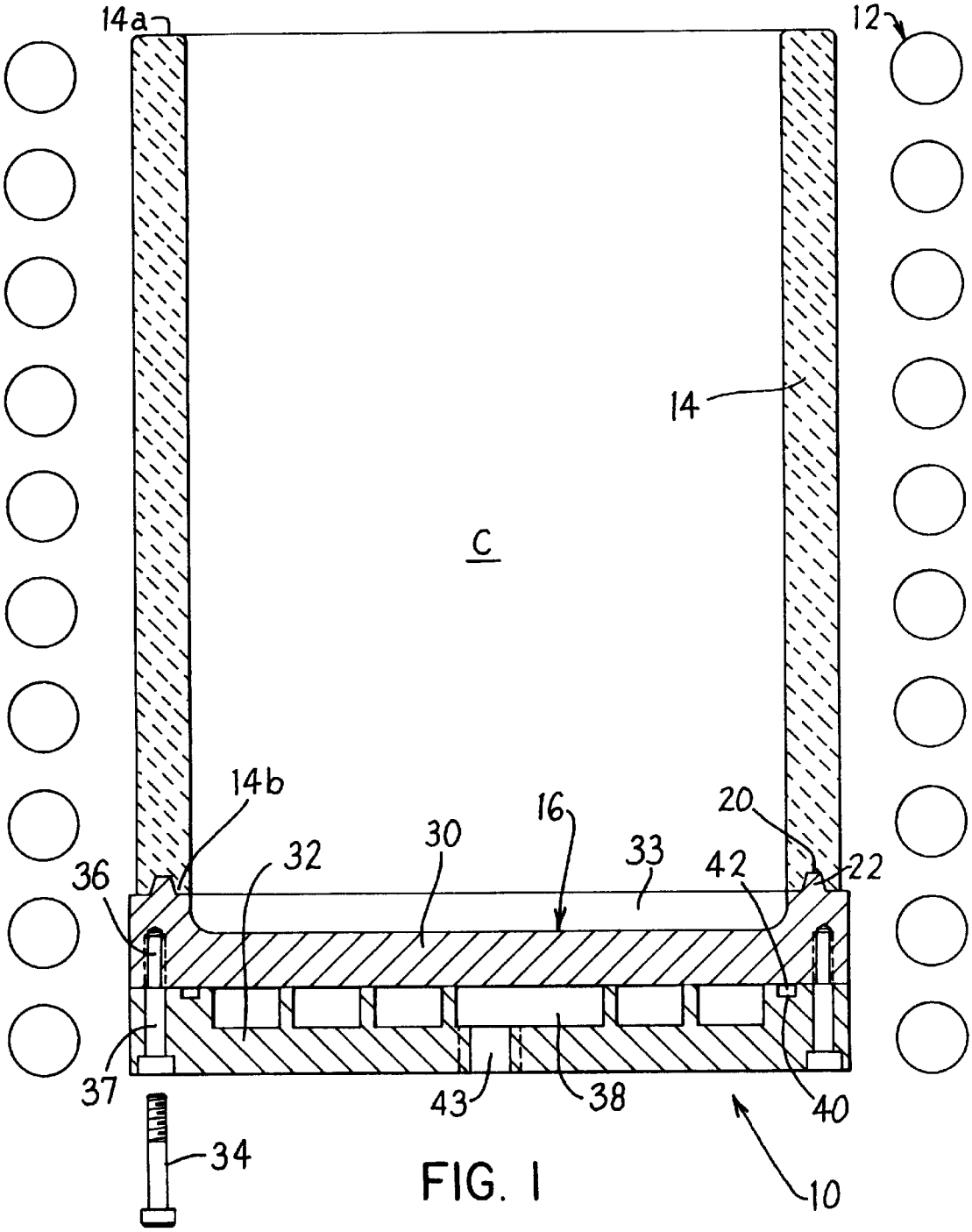
FIG. 1 is a cross-sectional view of induction melting apparatus in accordance with one embodiment of the invention.

Referring to FIG. 1, an induction skull melting apparatus is illustrated for melting a solid charge of metal or alloy, such as, for example only, nickel or cobalt based superalloys, titanium and titanium alloys and other metals and alloys.

The apparatus includes a melting crucible 10 and induction coil 12 disposed about the crucible 10 to inductively heat the charge and melt it. The crucible 10 includes a reusable upstanding monolithic refractory tubular sleeve 14 disposed on a reusable water cooled metallic base 16.

The monolithic refractory tubular sleeve 14 typically comprises a refractory right cylinder having upper annular end 14*a* and lower annular end 14*b*. The lower annular end 14*b* includes an upwardly converging upstanding slot 20 formed therein. The slot 20 is sized and shaped complementary to an upstanding upwardly converging annular rib 22 extending about the periphery of the metallic base 16 so as to sealingly receive the rib 20 therein when the sleeve 14 is assembled on the base 16 as shown. The mating of the slot 20 and rib 22 prevents molten metal from leaking out of the crucible before a solidified lining or skull is formed in the crucible. There is no need to provide any other sealant between the lower end 14*b* of the sleeve 14 and the metallic base 16.

The monolithic refractory sleeve 14 can comprise alumina, zirconia, and other suitable ceramic material compatible with the metal or alloy to be melted. For example, a commercially available alumina ceramic sleeve 14 can be used in the induction melting of nickel, cobalt or iron based superalloys. A commercially available zirconia ceramic sleeve 14 can be used in the induction melting of conventional titianium and its alloys. Ceramic sleeves of these types typically comprise pressed and sintered ceramic powder tubes and are available form Howmet Corporation, Whitehall, Mich., and Thermal Ceramics, Plymouth, Mich.

Alternately, the monolithic refractory sleeve 14 can comprise graphite. A graphite sleeve 14 can be used in the induction melting of titanium, amorphous alloys, such as Vitreloy, and others. A graphite sleeve 14 suitable for practicing the invention is available commercially from Bay Carbon Inc., Bay City, Mich. A typical inner diameter of the refractory sleeve 14 is in the range of 3 to 15 inches with a typical wall thickness in the range of ¼ to 2 inches. The height of the ceramic sleeve 14 typically is in the range of 3 to 20 inches.

The water cooled base 16 comprises first and second machined disc shaped members 30, 32 having circular peripheries. Member 30 comprises copper while member 32 can comprise copper, steel, or aluminum. The upper base member 30 is scalloped to form a recess or cavity 33 that cooperates with the sleeve 14 to form an internal melting chamber C of the crucible.

The base members 30, 32 are connected together by a plurality of circumferentially spaced apart screws 34 received in threaded bores 36 machined in the upper base member 30 and unthreaded bores 37 machined in the lower base member 32.

Figure 2:
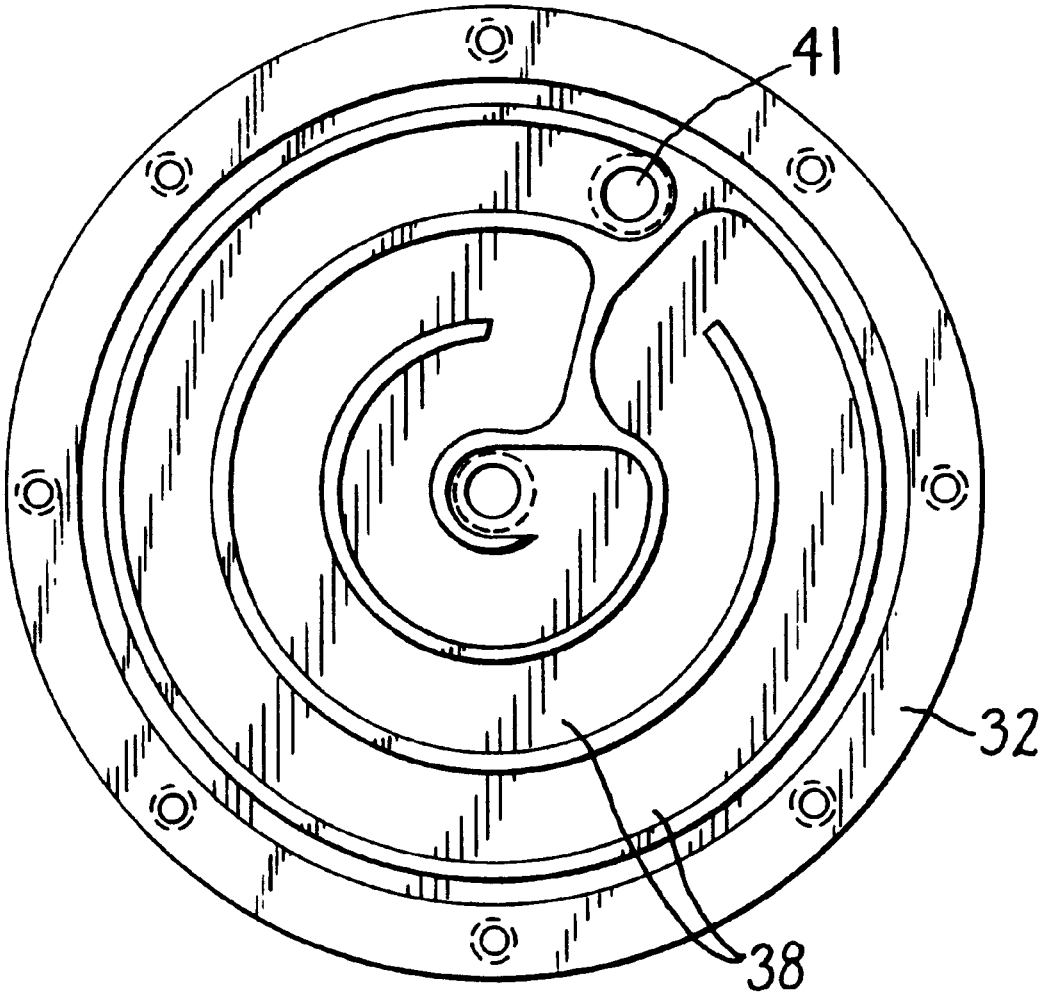
FIG. 2 is a plan view of the crucible base.

The lower base member 32 is machined to form a water cooling channel 38 that is closed off by the base member 30 when assembled therewith and that receives cooling water via a water inlet port 43 machined in the lower base member 32 and includes water outlet 41. The water cooling channel 38 extends in a configuration of a spiral passage as shown in FIG. 2. The lower base member 32 includes an annular, circumferential groove 40 in which an O-ring seal 42 is disposed to seal on the upper member 30 when the base members 30, 32 are connected together as shown to prevent water leakage.

The induction coil 12 comprises a hollow, water cooled coil energized by a conventional source of electrical power (not shown), such as a 50 Kilowatt power source, to inductively heat the charge in the crucible chamber C to a molten state. The induction coil 12 surrounds or encompasses both the sleeve 14 and the base 16 as shown in FIG. 1.

A solid charge of metal or alloy, such as nickel or cobalt based superalloy, titanium or titanium alloy, is placed in the melting chamber C, and the induction coil 12 is energized at an electrical power level for a time to melt the charge to a molten state. For reactive metals and alloys such as superalloys and titanium and its alloys, the melting operation is conducted under a suitable vacuum or inert gas to prevent reaction with oxygen present in ambient atmosphere. A thin soldified lining or skull of the metal or alloy forms in-situ on the upper, inner surface of the base member 30 and on the inner surface of the monolithic sleeve 14 shortly after the charge reaches the molten state. The lining or skull typically has a thickness in the range of 0.001 to 0.25 inches. Thereafter, the molten metal or alloy is confined or contained within the solidified metal or alloy skull until the molten charge is poured or otherwise removed from the crucble 10, for example, to a conventional mold (not shown) for vacuum or other casting with the solidified lining or skull left in place on the inner surfaces of the sleeve 14 and base 16. The crucible comprising the sleeve 14 on the base 16 then can be reused in melting another solid charge of the metal or alloy.

EXAMPLE I

In melting a solid charge (12 pounds) of a nickel base superalloy, the crucible comprised an $A1_2O_3$ ceramic sleeve 14 with a inner and outer diameter of 5.5 inches and 6.75 inches, respectively, and height of 9 inches on a water cooled copper base 16. The induction coil was energized at 150 Kilowatts for 10 minutes to form a melt at a temperature of 2600 degrees F. The melting operation was conducted under a vacuum of less than 1 torr. The melt then was poured into an investment mold. A thin solidified superalloy skull of approximate thickness of 0.010 inch remained in the crucible.

EXAMPLE II

In melting a solid charge (12 pounds) of a gamma titanium alloy, the crucible comprised a $Zr_2O_3$ ceramic sleeve 14 with a inner and outer diameter of 5.5 inches and 6.75 inches, respectively, and height of 9 inches on a water cooled copper base 16. The induction coil was energized at 150 Kilowatts for 15 minutes to form a melt at a temperature of 2900 degrees F. The melting operation was conducted under a vacuum of less than 1 torr. The melt then was poured into an investment mold. A thin solidified titanium alloy skull of approximate thickness of 0.010 inch remained in the crucible.

The invention is advantageous in that use of the monolithic sleeve 14 and base 16 eliminates the need for refractory packing materials as well as $CaF_2$ and other refractory foreign skulls that can contaminate the melt. Cleaner melts thus are produced using the crucible of the invention. In addition, use of the monolithic refractory sleeve 14 eliminates the water cooled crucible sleeve segments or fingers previously used. The induction melting apparatus of the invention provides improved service in melting metal or alloy charges in a production environment in that damage to or spreading of previously used metal crucible segments or fingers is eliminated as a source of crucible downtime. Moreover, the invention provides greater levitation of the melt in the crucible to reduce reaction with the crucible before the skull forms thereon.

Although the invention has been described hereinabove in terms of specific embodiments thereof, it is not intended to be limited thereot but rather only to the extent set forth hereafter in the appended claims.

What is claimed is:

1. Induction melting apparatus, comprising a crucible including a reusable monolithic refractory tubular sleeve disposed on a water cooled metallic base, said sleeve and said base defining a melting chamber, and induction coil means disposed about said sleeve metallic, said sleeve and said base defining a mating annular slot and sealing rib at their juncture.

2. The apparatus of claim 1 wherein the crucible sleeve includes a lower end with an upstanding slot receiving an upstanding sealing rib on the base.

3. The apparatus of claim 1 wherein the base includes a recess formed in an upper surface and that cooperates with the sleeve to form the melting chamber.

4. The apparatus of claim 1 wherein the sleeve comprises a ceramic material.

5. The apparatus of claim 1 wherein the sleeve comprises graphite.

6. The apparatus of claim 1 wherein the sleeve comprises a right cylinder.

7. The apparatus of claim 1 wherein the base comprises first and second members that define a water cooling channel therebetween.

8. Induction melting apparatus, comprising a crucible including a reusable monolithic refractory tubular sleeve disposed on a water cooled metallic base, said sleeve and said base defining a melting chamber, and induction coil means disposed about said sleeve metallic, said base including a recess that is formed in an upper surface thereof and that cooperates with said sleeve to form said melting chamber.

9. Induction melting apparatus, comprising a crucible including a reusable monolithic refractory tubular sleeve disposed on a water cooled metallic base, said sleeve and said base defining a melting chamber, and induction coil means disposed about said sleeve metallic, said base including first and second base members that define a water cooling channel therebetween.

10. The apparatus of claim 9 wherein the first and second base members are connected together by circumferentially spaced fastening means.

* * * * *

UNITED STATES PATENT AND TRADEMARK OFFICE

CERTIFICATE OF CORRECTION

PATENT NO. : 6,214,286 B1
DATED : April 10, 2001
INVENTOR(S) : Donald E. Larsen et al.

It is certified that error appears in the above-identified patent and that said Letters Patent is hereby corrected as shown below:

Column 4,
Line 46, delete "metallic".

Column 5,
Line 1, delete "metallic".

Column 6,
Line 1, delete "metallic".

Signed and Sealed this

Fifth Day of March, 2002

*Attest:*

*Attesting Officer*

JAMES E. ROGAN
*Director of the United States Patent and Trademark Office*